United States Patent [19]

Meyr et al.

[11] 4,225,962

[45] Sep. 30, 1980

[54] MOSAIC PRINTER

[75] Inventors: Heinrich Meyr, Aachen, Fed. Rep. of Germany; Claude Georges, Münsingen, Switzerland

[73] Assignee: Hasler AG Bern, Bern, Switzerland

[21] Appl. No.: 960,828

[22] Filed: Nov. 15, 1978

[30] Foreign Application Priority Data

Nov. 15, 1977 [CH] Switzerland ..... 013906/77

[51] Int. Cl.[2] ..... H04L 17/20

[52] U.S. Cl. ..... 375/2; 178/30; 178/69 G

[58] Field of Search ..... 178/30, 69 G, 22; 400/89

*Primary Examiner*—Howard A. Birmiel

*Attorney, Agent, or Firm*—James T. English

[57] ABSTRACT

A mosaic printer is made secure from unauthorized interception of data by falsifying the needle drive pulse current magnitude and sequence so that electromagnetic leakage radiation cannot be used to determine the alphanumeric data being printed. This falsification is accomplished by a compensation device having compensators energized each print cycle in addition to the printer needle drives in a reciprocal or a pseudorandom manner. The compensators have current consumption characteristics nominally identical to the needle drives and produce substantially identical radiation pulses, making it impossible to correlate the radiated pulse format with the symbol being printed.

4 Claims, 3 Drawing Figures

MOSAIC PRINTER

A request for the Priority Date of Nov. 15, 1977 is hereby made in this application, in view of the filing of a patent application in Switzerland (a convention country) of the same subject matter, by the same coinventors. The Swiss patent application has the number 013906/77 and was filed on Nov. 15, 1977 and is titled "Mosaicdrucker"

BACKGROUND OF THE INVENTION

1. Field of the Invention

This invention relates generally to secure communications, and more specifically to a method for rendering a teletypewriter using a mosaic printer (i.e., a printer operating on the principle of a dot matrix, for example a 5×7 matrix of dots) whereby the dots are caused by needles driven at high velocity by electromechanical drives. The electromechanical drives place a high impulsive load on a power supply causing superimposed modulation thereon and on associated power utility lines to the power supply whereby the superimposed modulation can be reconstructed to determine the registration and symbols of the printed text. Similarly, the high currents in the electromechanical drives and connecting lines tend to radiate into the surrounding space such that a receiver for electromagnetic radiation pulses some distance away can be used to covertly deduce the registration and symbols of the printed text. Simple inductive pickup loops placed on the power utility lines can similarly be used some distance away from the teletypewriter printer to receive drive pulse information to deduce the printed text.

2. Description of the Prior Art

The prior art shows mosaic printers with an integer number of printing needles driven by separate electromechanical drives connected to a selection logic for selecting the needles to be actuated, having an electrical power source loadable impulsively. Mosaic or "needle" printers have been on the market for some time and are generally well known. They are fast and relatively quiet. The printing needles are individually controlled from a selection logic. Generally the needle drives are arranged perpendicularly to the writing direction which results in printed dot columns. Each complete symbol is made up of several adjacent columns forming a dot matrix.

Higher and higher printing speeds are being aimed at with advanced technology. As a result, the needles have to be accelerated and stopped very rapidly. In the prior art the most common drive is the electromechanical drive consisting of a solenoid exerting a repelling force on a needle movable along the axis of the solenoid. The existence of a high impulsive field in the solenoid is the reason why mosaic printers are not used whenever the text is likely to contain confidential information.

The pertinent classes and subclasses; i.e., class 101 "Printers and Printing", Class 178, subclasses 23, 37, and 99 "Telegraphy" as well as Class 400, subclass 89 "Cryptography" related to typewriting, do not show any means for falsifying the electromagnetic pulse radiation of an electromechanically driven printer to eliminate correspondence thereof to the printed symbols.

SUMMARY OF THE INVENTION

The invention is based on the principle of falsifying any electromagnetic stray fields so that they do not yield any information about the text being printed. The invention is characterized by a compensation device which simulates the electrical characteristics of the drives and of their connecting lines and which is placed in close proximity with these drives and lines, and by means for switching the compensation device on simultaneously with the drives each print cycle; i.e., the period from receipt of a print instruction to the impact of the needles on the paper.

It is a primary object of the invention to provide a means for falsifying the strength and sequence of the radiated pulses so that each symbol, which is made up of a fixed series of different drive combinations, cannot be determined from stray fields.

It is another object of the invention to provide a compensation device to simulate the electrical characteristics of the drives and their connecting lines which can be added to existing mosaic printers, being placed close to the drives and connecting lines, emulating a single radiation source.

It is yet another object of the invention to provide a selection unit which can be encoded by a pseudorandom code generator to make decoding of the stray pulse electromagnetic fields by unauthorized persons virtually impossible.

DETAILED DESCRIPTION OF INVENTION

Figure 1:
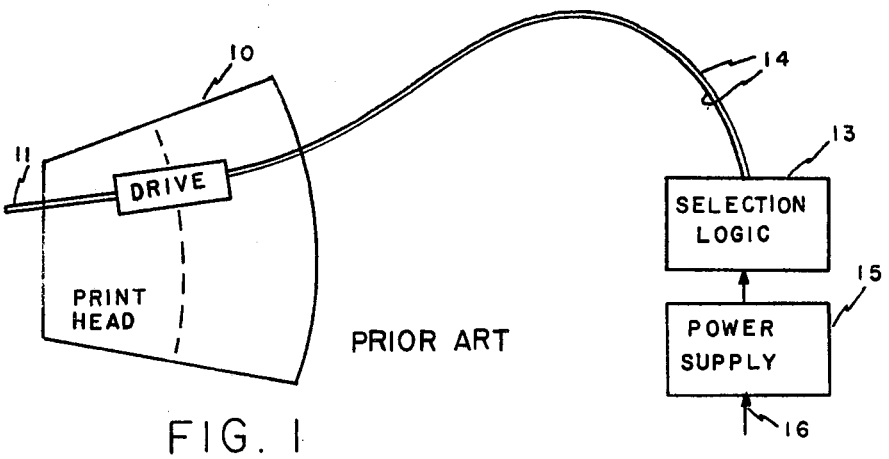
FIG. 1 shows a simplified partial schematic diagram of a mosaic printer in the prior art.

FIG. 1 shows the principal design of a mosaic printer. The printing head 10 unites a plurality of printing units of which only one is shown. Each printing unit consists of a printing needle 11 and a corresponding drive 12. The operative mechanism of the drive can be electromagnetic, piezoelectric, of electrostatic, etc. In general the printing head 10 is mounted on a carriage (not shown) which is movable stepwise in both directions along the printing line. A selection logic 13 which selects the printing needles 11 to be actuated, is shown. One of the two-way connecting lines 14 which supply the drive 12 with power is also shown in the figure. Thus FIG. 1 shows only the prior art.

Generally the selection logic 13 is mounted fixedly on the printer frame whereas the printing head 10 is movable. Because of this the connecting lines 14 are in general relatively long. They act as antennas for the high value pulse currents, which radiate a portion of the needle activation energy into space as electromagnetic radiation. Additional radiation comes from the drives 12.

Pulse currents in the connecting lines 14 places variable loads on the power supply 15, which in turn results in a variation of the supply current from the power utility lines 16. This superimposed current modulation introduces a possibility for unauthorized access to the mosaic printer via the power lines by a simple electromagnetic pickup coil placed on the lines, or by a direct connection to the lines, It is also known that information may be obtained from power line ground connecting lines in certain cases. Mosaic printers may thus be tapped by many different methods.

Figure 2:
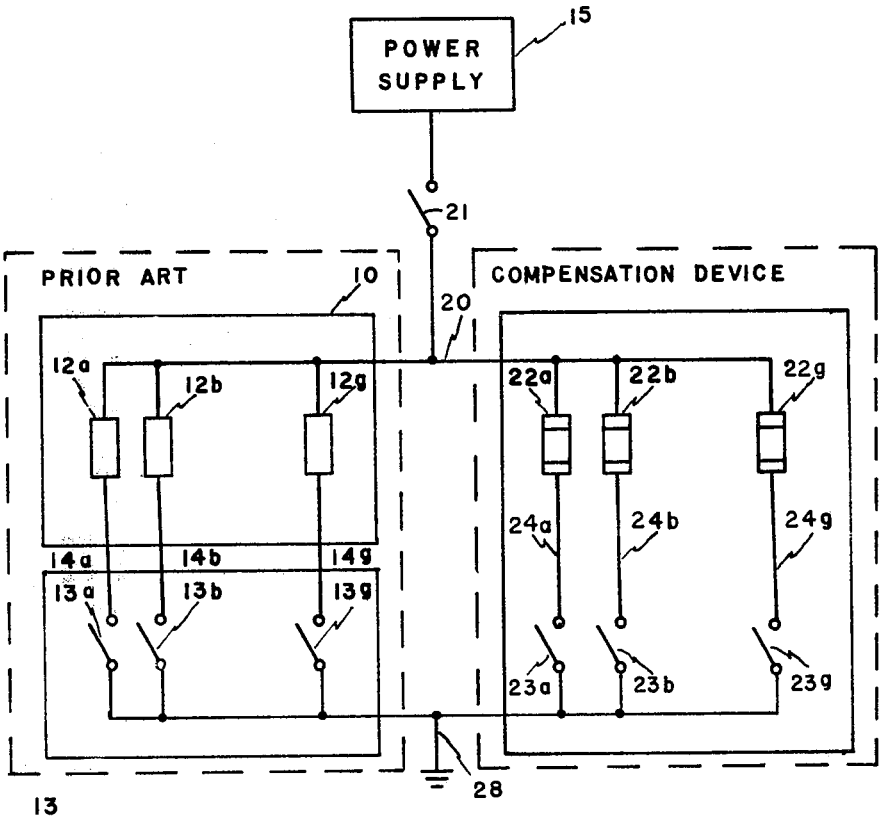
FIG. 2 shows a partial circuit diagram of a mosaic printer with the additional compensation device in accordance with the invention.

FIG. 2 shows the main electrical schematic diagram of a mosaic printer in the prior art in combination with the novel built-in additional compensation device in accordance with the invention. The drives 12*a* to 12*g* are connected to line 20 in parallel. As a whole they make up the needle actuating means of the printing head. Each time a printing cycle takes place, line 20 is connected momentarily to the power supply 15 through switch 21. The switches 13*a* to 13*g* select the printing needles to be actuated. Therefore these switches represent a part of the selection logic 13. The drives 12*a* to 12*g* are connected to the switches 13*a* to 13*g* through connecting lines 14*a* to 14*g*. These lines are relatively long as already indicated in the description of FIG. 1.

In addition to the drives 12*a* to 12*g*, the novel compensation device 22 is also connected to line 20. It consists of the compensation units (compensators) 22*a* to 22*g*, which are connected in parallel and act to simulate the electrical characteristics of the drives 12*a* to 12*g*. Also part of the compensation device 22 are the lines 24*a* to 24*g* simulating the lines 14*a* to 14*g* and the switches 23*a* to 23*g* simulating the switches 13*a* to 13*g*. One terminal of every switch is connected to a ground line 28.

Figure 3:
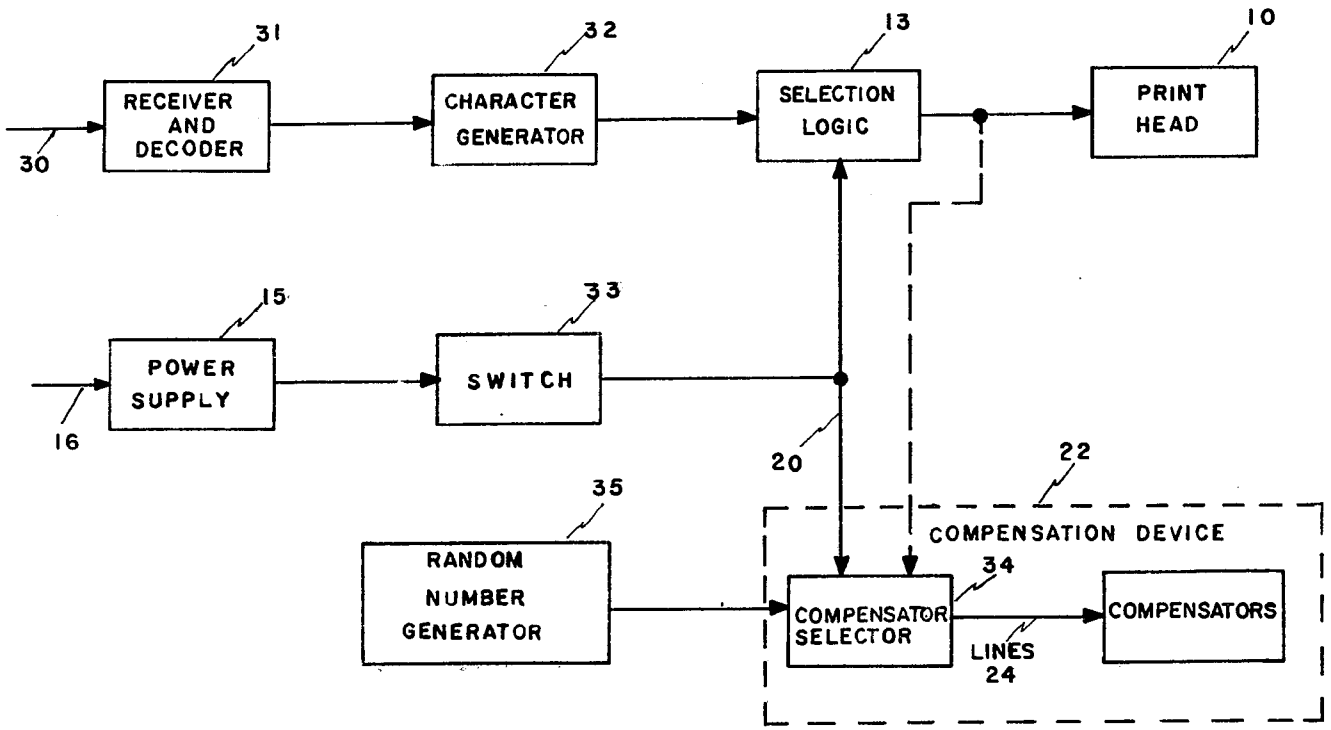
FIG. 3 shows a block diagram of a teletypewriter with a mosaic printer and a compensation device in accordance with the invention.

FIG. 3 shows the block diagram of a teletypewriter which incorporates a mosaic printer and a compensation device. The telex transmission pulses coming in via the telegraph line 30, are received by the receiver and decoder 31. The telex characters are decoded in this unit and processed in a known fashion. The character generator 32 eventually determines which printing needle drives have to be switched so that the required symbol composed of the individual dots made by the printing needles appears on the paper. The selection logic 13 with its switches 13*a* to 13*g* (See FIG. 2) switches the drives 12*a* to 12*g* of the printing head 10. The printing cycle is performed in that the connection unit 33, being identical to switch 21 in FIG. 2, connects the power supply 15 with line 20 for a short time.

The compensation device 22 is connected in parallel with selection logic 13. Thus this device 22 and the selection logic 13 are switched to the power supply 15 simultaneously by connection unit 33. The energy supplied by the power supply 15 in every printing cycle thus depends on the power required by the switched drives 12 of the printing head 10 and by the switched comparators 22*a* to 22*g* of the compensation device 22. Thus it is not possible to derive the number of drives 12*a* to 12*g* switched by detecting the strength of the current pulses in the line 20, in the drives 12 and in the compensation device 22.

There are alternative embodiments possible in implementing the compensator selection unit 34 of the compensation device 22. A preferred arrangement has, as shown in FIG. 2, the same number of switches 23*a* to 23*g* as there are in the selection logic 13. By physically combining switch 13*a* with switch 23*a*, 13*b* with 23*b*, etc., up to 13 g with 23*g*, in a manner such that either a drive or a compensator switch is activated at each printing cycle, exactly 7 (a through g) or in general n drives 12 and/or compensators 22*a* to 22*n* are switched. The load on the power supply 15 thus remains constant for every printing cycle, except for fluctuations attributable to the variation from nominal electrical characteristics of the actual drives and compensators.

Another possibility is to control the compensator selector 34 by an additional random number generator 35. In this case, at each printing cycle additional to the current required by the printing head 10 a current is added by the compensation device 22 whose value depends on the random number generated and corresponds to 0, 1, 2, . . . i compensator drive currents.

There are various ways for combining the logic of the compensator selector 34 with values of the random number generator 35. In the simplest case a linear relationship is chosen. This means, for every random number, a corresponding number of compensators 22*a* to 22*g* are switched, and their currents are added to the printing head currents. By this a statistical falsification of the current values in line 20 is achieved. Therefore it is difficult to derive the printed symbol from the current values. Even a few compensation units 22*a* to 22*g* are adequate for achieving the required falsification. With somewhat more effort, it is possible to achieve a degree of falsification which is not possible to overcome with any known technical means. For better comprehension, the following definitions and formulae are needed: Let k=Number of drives 12*a* . . . 12*n* to be switched (k=0 . . . n)

s=Momentary random number from the random number generator 35. (s=0 . . . m, equally distributed in the interval 0 . . . m; m≧n)

z=Number of compensation units 22*a* to 22 . . . to be switched.

c=Sum of the number of drives and of compensators to be switched.

q=Constant amount (q≧n).

From the definition of c, we have, $$c=k+z$$

It is known from cryptology that in order not to obtain any information from c we must have $$c=(k+s)_{mod\ (m+1)}$$

The numbers must therefore be added modulo (m+1). Combining the two equations and solving for z yields $$z=(k+s)_{mod\ (m+1)}-k$$

with $$z=-n \ldots +m.$$

Since negative values of z are technically impossible, they may be displaced by adding a constant amount q so that all values are positive, without changing anything cryptologically.

The number of compensators to be switched is therefore, $$z'=(k+s)_{mod\ (m+1)}-k+q$$

and the sum of the number of drives and compensators to be switched is therefore, $$c'=k+z'=(k+s)_{mod\ (m+1)}+q$$

In the following table, for the case where n=m=q=7, the values of z' (in the lower left half of every field in the table) and of c' (in the corresponding upper right half) are listed as functions of k and s.

TABLE I

| s \ k | 0 | 1 | 2 | 3 | 4 | 5 | 6 | 7 |
|---|---|---|---|---|---|---|---|---|
| 0 | 7 / 7 | 8 / 7 | 9 / 7 | 10 / 7 | 11 / 7 | 12 / 7 | 13 / 7 | 14 / 7 |
| 1 | 8 / 8 | 9 / 8 | 10 / 8 | 11 / 8 | 12 / 8 | 13 / 8 | 14 / 8 | 7 / 0 |
| 2 | 9 / 9 | 10 / 9 | 11 / 9 | 12 / 9 | 13 / 9 | 14 / 9 | 7 / 1 | 8 / 1 |
| 3 | 10 / 10 | 11 / 10 | 12 / 10 | 13 / 10 | 14 / 10 | 7 / 2 | 8 / 2 | 9 / 2 |
| 4 | 11 / 11 | 12 / 11 | 13 / 11 | 14 / 11 | 7 / 3 | 8 / 3 | 9 / 3 | 10 / 3 |
| 5 | 12 / 12 | 13 / 12 | 14 / 12 | 7 / 4 | 8 / 4 | 9 / 4 | 10 / 4 | 11 / 4 |
| 6 | 13 / 13 | 14 / 13 | 7 / 5 | 8 / 5 | 9 / 5 | 10 / 5 | 11 / 5 | 12 / 5 |
| 7 | 14 / 14 | 7 / 6 | 8 / 6 | 9 / 6 | 10 / 6 | 11 / 6 | 12 / 6 | 13 / 6 |

As may be seen, every column and row for c′ contains exactly the numbers from 7 to 14, which corresponds to an statistically equal distribution.

The hardware realization of the method described consists of the random number generator 35 already described and of a logic circuit contained in the compensator selector 34, realizable easily by one skilled in the art and generating the values of z′ in correspondence with the above table. For this the values of k must be given to the compensator selector 34 over lines (dashed line, FIG. 3) between the selection logic 13 and the compensator selector 34. Furthermore, a larger number of compensators 22*a* to 22 . . . n is required; in the given example, a total of 14 compensators are required.

Random number generators are known. Therefore no explanation shall be given here on the construction of the random number generator used. In some cases, it is quite adequate to use a pseudo-random number generator; for example, a linear feedback shift register with maximum period could be used.

The basis for the effective use of each of the given alternatives is that the electrical characteristics of the compensation device 22 are as far as possible identical to the electrical characteristics of the drives 12, the lines 14 and the switches 13. In addition, the combined equipment must be arranged physically in such a manner that the pulse stray fields generated by the printing and compensation cycles seem to come from the same source.

The invention does not depend on the number of printing needles 11 in the printing head 10. In FIg. 2, seven needle drives 12*a* to 12*g* are shown; this corresponds to a frequently used configuration. But any other number of drives may be used. In the general case of n drives (n=integer) there must be a corresponding number n of compensators 22*a* to 22*n*.

In the second example in which the compensator selector 34 is directly controlled by a random number generator 35, fewer compensators; for example 22*a* to 22*e* are all that are needed to effectively mask the number of drives 12 selected. In the third example, a total of 14 compensators is required, and for the general case a total of (m+q) compensators are required.

The advantage of the invention basically lies in the fact that the security of a mosaic printer can be assured using relatively few active components. Passive means such as screening or shielding the printer, buffering the feeding voltage at the input or output of the power supply, etc., are not effective to achieve the degree of security required.

What is claimed is:

1. In a mosaic printer of the type for printing alphanumeric symbols having an integer number n of printing needles driven by separate electromechanical drives through electric lines connected to the input of selection logic having an output connected to the electromechanical drives for selecting the needles to be actuated each print cycle to form the symbols, and having an electrical power source loadable impulsively by said electromechanical drives, the current pulses corresponding to said symbols, the improvement which comprises:

a compensation device having a plurality of compensators and compensator electric lines simulating the electrical characteristics of said electromechanical drives and their said electric lines, said plurality of compensators and compensator electric lines being positioned close to said electromechanical drives and said electric lines, said compensation device also having a compensator selector for selecting which of said plurality of compensators and compensator electric lines are to be energized, connected at the output to said compensator electric lines, said compensator selector having first second and third inputs;

means for switching power from said power source to said compensation device at said first compensator selector input simultaneously with power to said selection logic at said input thereof;

whereby electric impulses in said electromechanical drives and electric lines and in said power source are combined with electric impulses in said compensators and said compensator electric lines and in said power source due to said compensator current loads, thereby eliminating correspondence of the impulsive loads on said power source and radiated pulses in said electromechanical drives and electric lines, to said symbols, maintaining the security of the printed text.

2. The mosaic printer of claim 1 wherein said compensation device comprises n compensators and n compensator electric lines, each having the same electrical characteristics as one of said electromechanical drives and one of said electric lines, and said compensator selector consists of n switches, each connecting either one of said electromechanical drives or one of said compensator electric lines and said compensators to said power source each print cycle, through said means for switching power, whereby a constant number of switches are operated per print cycle and drawing a constant current from said power source.

3. The mosaic printer of claim 1 wherein said compensation device comprises a plurality of compensators and compensator electric lines, each simulating the electrical characteristics of one of said electromechanical drive and electric line, and said compensator selector is driven by a random number generator connected to said second input of said compensator selector and said selection logic output is connected to said compensator selector at said third input; and means for combining signals at said second and said third compensator selector inputs to control said compensator selector.

4. The mosaic printer of claim 3 wherein said means for combining signals incorporates logic selecting $$z' = (k+s)_{mod\ (m+1)} - k + q$$

compensators when k drives are to be switched, the random numbers from said random number generator being integer s which are equally distributed over the interval from 0 to m, where m is larger than or equal to n and where q is a constant integer larger than or equal to n.

* * * * *